US006850261B2

(12) United States Patent
Taki et al.

(10) Patent No.: US 6,850,261 B2
(45) Date of Patent: Feb. 1, 2005

(54) PHOTO FIXER AND THERMAL PRINTER HAVING THE SAME

(75) Inventors: Tomoko Taki, Saitama (JP); Hideyuki Kokubo, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 153 days.

(21) Appl. No.: 10/253,428

(22) Filed: Sep. 25, 2002

(65) Prior Publication Data

US 2003/0063181 A1 Apr. 3, 2003

(30) Foreign Application Priority Data

Sep. 28, 2001 (JP) ..... 2001-303801

(51) Int. Cl.[7] ..... B41J 2/385; B41J 2/435
(52) U.S. Cl. ..... 347/156; 347/228
(58) Field of Search ..... 347/156, 171, 347/224, 228, 175, 212, 215, 226, 102; 400/120.04; 101/211

(56) References Cited

U.S. PATENT DOCUMENTS

| | | | | | |
|---|---|---|---|---|---|
| 5,743,663 | A | * | 4/1998 | Imai | 400/120.04 |
| 6,011,569 | A | * | 1/2000 | Pockett | 347/151 |
| 6,380,962 | B1 | | 4/2002 | Miyazaki | 347/171 |
| 6,414,703 | B1 | * | 7/2002 | Sugiyama et al. | 347/175 |
| 2003/0154871 | A1 | * | 8/2003 | Laksin et al. | 101/211 |

FOREIGN PATENT DOCUMENTS

JP 2001-155688 6/2001

* cited by examiner

*Primary Examiner*—Hai Pham
(74) *Attorney, Agent, or Firm*—Sughrue Mion, PLLC

(57) ABSTRACT

A color thermal printer includes a photo fixer, which is constituted by a Braun tube. An electron beam gun emits electron. A fluorescent screen is excited by the electron, for generating near ultraviolet rays or ultraviolet rays. An image on thermosensitive recording material is fixed by application of the near ultraviolet rays or ultraviolet rays.

23 Claims, 4 Drawing Sheets

PHOTO FIXER AND THERMAL PRINTER HAVING THE SAME

BACKGROUND OF THE INVENTION

1. Field of the Invention

The present invention relates to a photo fixer and thermal printer having the same. More particularly, the present invention relates to a photo fixer and thermal printer having the same, in which a control of an amount of fixing rays can be efficient and easy, and no shutter for shielding fixing rays is required.

2. Description Related to the Prior Art

A color thermal printer is used with color thermosensitive recording paper, and produces full-color prints. The recording paper includes a support and at least three thermosensitive coloring layers overlaid thereon. Among the three, a coloring layer which is positioned the farther from the support has a higher heat sensitivity, and colorable in response to lower heat energy. The two coloring layer being not near to the support have such fixability that its coloring ability is destroyed when near ultraviolet or ultraviolet rays is applied to the recording paper. While the recording paper is moved back and forth in the color thermal printer, a thermal head pressurizes and heats the recording paper to record three color images to the coloring layers. After the thermal recording, a photo fixer is driven to apply ultraviolet rays to the recording paper. The first and second coloring layers are fixed and prevented from developing further color upon coloring of the second and third coloring layers.

The use of light sources including mercury has been recently reconsidered because waste mercury contaminates the environment. In view of this, JP-A 2001-155688 suggests the photo fixer which is constituted by a xenon lamp free from mercury. However, the xenon lamp is in a rod shape, is circular as viewed in cross section, and emits ultraviolet rays at a regular intensity in any of portions in the entirety of the xenon lamp. There is a suggestion of a reflector, which is disposed in the vicinity of the xenon lamp, and reflects waste part of the ultraviolet rays toward the recording paper with high performance of reflection.

When the xenon lamp of the straight shape is used, it is impossible to limit a ray applying region of ultraviolet rays without adding extra elements to the xenon lamp. So a shutter mechanism is additionally disposed in the color thermal printer for use with the recording paper of a continuous type. The shutter mechanism is set to cover an unrecorded portion in the recording paper when the photo fixer consists of the xenon lamp of the straight type. However, a problem arises in that the shutter mechanism has a considerable dimension and is inconsistent to reduction of the size of the color thermal printer.

In general, states of fixing the coloring layers are important for high quality in printing the image. The use of the xenon lamp has a shortcoming in much difficulty in controlling the light amount because efficiency in the light emission is heightened by application of high frequency between electrodes. It is very difficult to set the xenon lamp at a desired intensity of light. Thus, high quality in printing is hard to obtain due to a difference between the fixing states of the coloring layers.

SUMMARY OF THE INVENTION

In view of the foregoing problems, an object of the present invention is to provide a photo fixer and thermal printer having the same, in which a control of an amount of fixing rays can be efficient and easy, and no shutter for shielding fixing rays is required.

In order to achieve the above and other objects and advantages of this invention, a photo fixer for fixing an image on recording material by application of electromagnetic rays is provided. An electron radiation source emits electron. A fluorescent screen is excited by the electron, for generating the electromagnetic rays.

The electromagnetic rays are near ultraviolet rays or ultraviolet rays. The recording material is thermosensitive recording material and has photo fixability in response to the near ultraviolet rays or ultraviolet rays.

The electron radiation source and the fluorescent screen constitute a Braun tube.

Furthermore, an electromagnetic ray applying surface is disposed in front of the fluorescent screen, for applying the electromagnetic rays being generated to the recording material. The Braun tube is a flat Braun tube in which the ray applying surface is flat.

The recording material is color thermosensitive recording material, and has plural thermosensitive coloring layers which have the photo fixability in response to the near ultraviolet rays or ultraviolet rays of respectively first and second wavelength ranges. The fluorescent screen has first and second phosphor materials disposed in a pattern two-dimensionally, excited by the electron, for emitting the near ultraviolet rays or ultraviolet rays of the first and second wavelength ranges.

According to another aspect of the invention, a thermal printer includes a thermal head for recording an image by heating thermosensitive recording material, and a photo fixer for fixing the image on the recording material by application of electromagnetic rays. In the thermal printer, the photo fixer includes an electron radiation source for emitting electron. A fluorescent screen is excited by the electron, for generating the electromagnetic rays.

The recording material is color thermosensitive recording material, having first, second and third thermosensitive coloring layers for developing at least three colors, initially the first coloring layer being colored by thermal recording, then the second coloring layer being colored by thermal recording, the first and second coloring layers having the photo fixability in response to the near ultraviolet rays or ultraviolet rays of respectively first and second wavelength ranges. The fluorescent screen includes a first area coated with first phosphor material. A second area is coated with second phosphor material, disposed adjacent to the first area, the first and second areas selectively emitting the near ultraviolet rays or ultraviolet rays of the first and second wavelength ranges.

Furthermore, a feeder feeds the recording material. The photo fixer includes an electromagnetic ray applying surface, disposed in front of the fluorescent screen, for applying the electromagnetic rays being generated to the recording material. An electron deflecting unit scans the electron from the electron radiation source on the fluorescent screen time-sequentially by deflecting the electron, switches emission of the electromagnetic rays individually between plural cells arranged in the ray applying surface, and turns off a first cell group of cells among the cells when the first cell group is opposed to a portion of the recording material outside a recording area designated for receiving the electromagnetic rays while the recording material is fed.

In another preferred embodiment, furthermore, a feeder feeds the recording material in a feeding direction. The thermal head records the image into a recording area in the recording material, to form a margin area between the recording area and a recording area disposed in the feeding direction thereto. The photo fixer has a first size in the feeding direction, the first size being smaller than a second size of the margin area in the feeding direction, the photo fixer turning off when opposed to the margin area.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
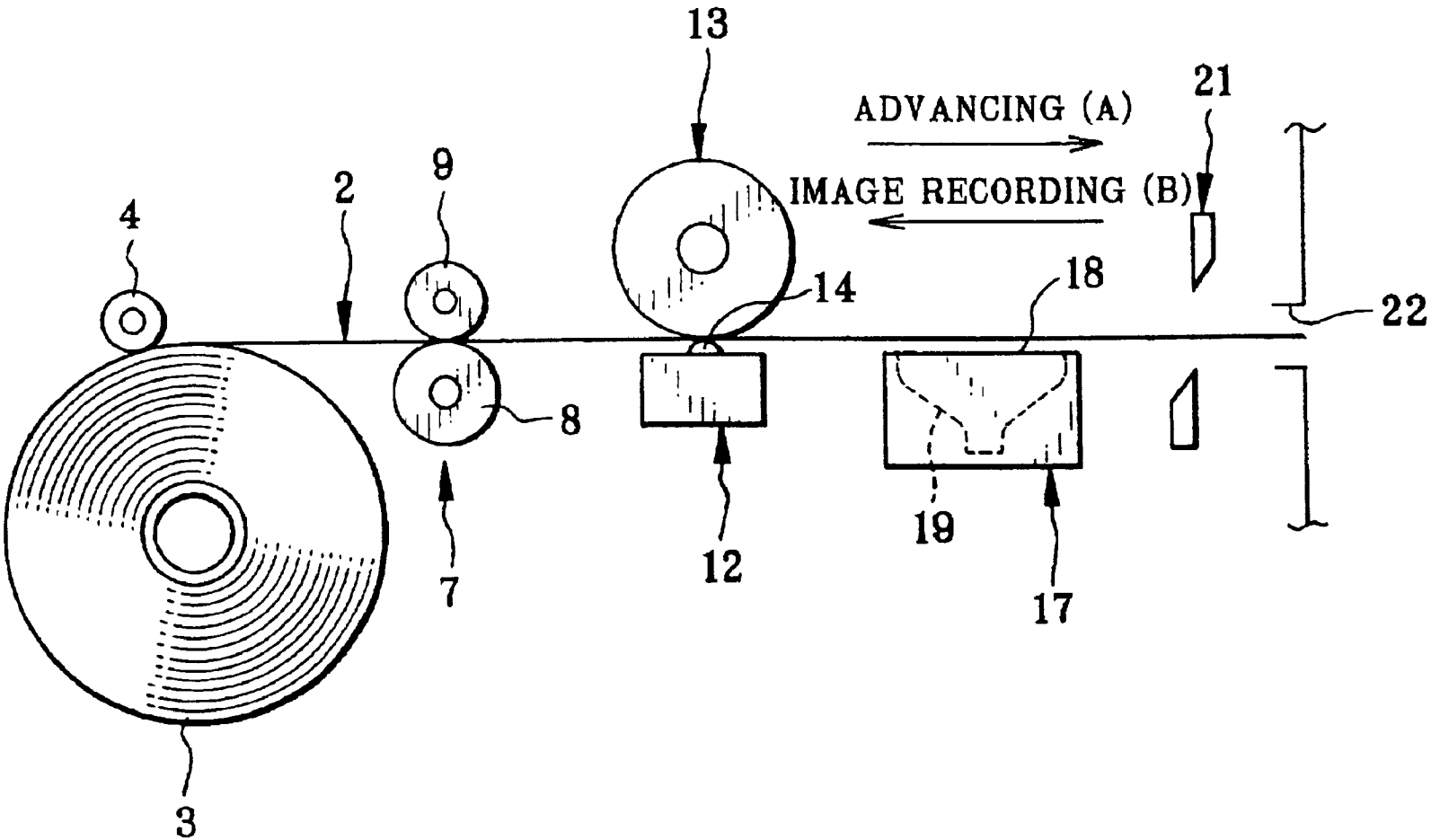
FIG. 1 is an explanatory view in side elevation, illustrating a color thermal printer.

In FIG. 1, a color thermal printer of the present invention is illustrated. A color thermosensitive recording material 2 in a continuous shape is used. A recording material roll 3 is initially prepared as a roll of the recording material 2, and is set in the thermal printer.

A supply roller 4 contacts an outermost turn of the recording material roll 3. A supply motor (not shown) drives the supply roller 4 to rotate. When the supply roller 4 rotates in the counterclockwise direction, the recording material roll 3 rotates in the clockwise direction. The recording material 2 is unwound and advanced from the recording material roll 3. In contrast, when the supply roller 4 rotates in the clockwise direction, the recording material roll 3 rotates in the counterclockwise direction. The recording material 2 is wound back to the recording material roll 3.

A feeder roller set 7 as feeder is disposed close to the recording material roll 3, and nips and conveys the recording material 2. The feeder roller set 7 is constituted by a capstan roller 8 and a pinch roller 9. A feeder motor (not shown) drives the capstan roller 8 to rotate. The pinch roller 9 is pressed toward the capstan roller 8 for nipping the recording material 2. The feeder roller set 7 moves the recording material 2 in an advancing direction A toward the right for the supply of the material, and in an image recording direction B toward the left for the image recording and return to the home position.

The recording material 2 includes a support and three thermosensitive coloring layers of colors of cyan, magenta and yellow overlaid thereon. Among the three, the yellow coloring layer is positioned the farthest from the support, has the highest heat sensitivity, and colorable in response to the lowest heat energy. The cyan coloring layer is positioned the nearest to the support, has the lowest heat sensitivity, and colorable in response to the highest heat energy. The yellow coloring layer has such fixability that its coloring ability is destroyed when near ultraviolet rays peaking at a wavelength of 420 nm is applied to the recording material 2. The magenta coloring layer has a medium heat sensitivity between the highest and lowest, and has such fixability that its coloring ability is destroyed when ultraviolet rays peaking at a wavelength of 365 nm is applied to the recording material 2. It is to be noted that a black coloring layer may be added to the coloring layers in the recording material 2 to define a four-layer structure.

A thermal head 12 and a platen roller 13 are disposed downstream from the feeder roller set 7 in the advancing direction A, and are so disposed that a path of the recording material 2 is located between those. The thermal head 12 is disposed under the recording material 2 in the feeding path. A heating element array 14 is included in the thermal head 12, and has a great number of heating elements arranged in one line in a main scan direction.

The platen roller 13 is disposed directly above the heating element array 14 on a side higher than the feeding path. The platen roller 13 is linked with a shifter mechanism having a cam, solenoid or the like, and is kept shiftable up and down. A spring (not shown) biases the platen roller 13 toward the thermal head 12. At the time of feeding or exiting of the recording sheet, the platen roller 13 is shifted up by the shifter mechanism, to form a gap between the thermal head 12 and the platen roller 13.

While the recording material 2 is conveyed in the image recording direction B by the feeder roller set 7, the thermal head 12 presses the recording material 2 against the platen roller 13. The heating element array 14 is driven to emit heat at a predetermined temperature, to develop color in each coloring layer in the recording material 2. The platen roller 13 is rotated by movement of the recording material 2.

A photo fixer 17 is disposed in a position downstream from the thermal head 12 in the advancing direction A, and opposed to a recording surface of the recording material 2. The photo fixer 17 basically consists of a small, flat Braun tube 19 or CRT as radiation source. A ray applying surface 18 of the Braun tube 19 is oriented upwards. Note that the recording material 2 has the recording surface oriented downwards.

According to the art of the Braun tube, a general-purpose Braun tube includes a screen, disposed inside a light emitting surface, and constituted by three types of phosphors for emitting light of red, green and blue colors. An electron beam gun emits a beam of electron, scans the phosphors selectively, to display a color image.

Figure 1A:
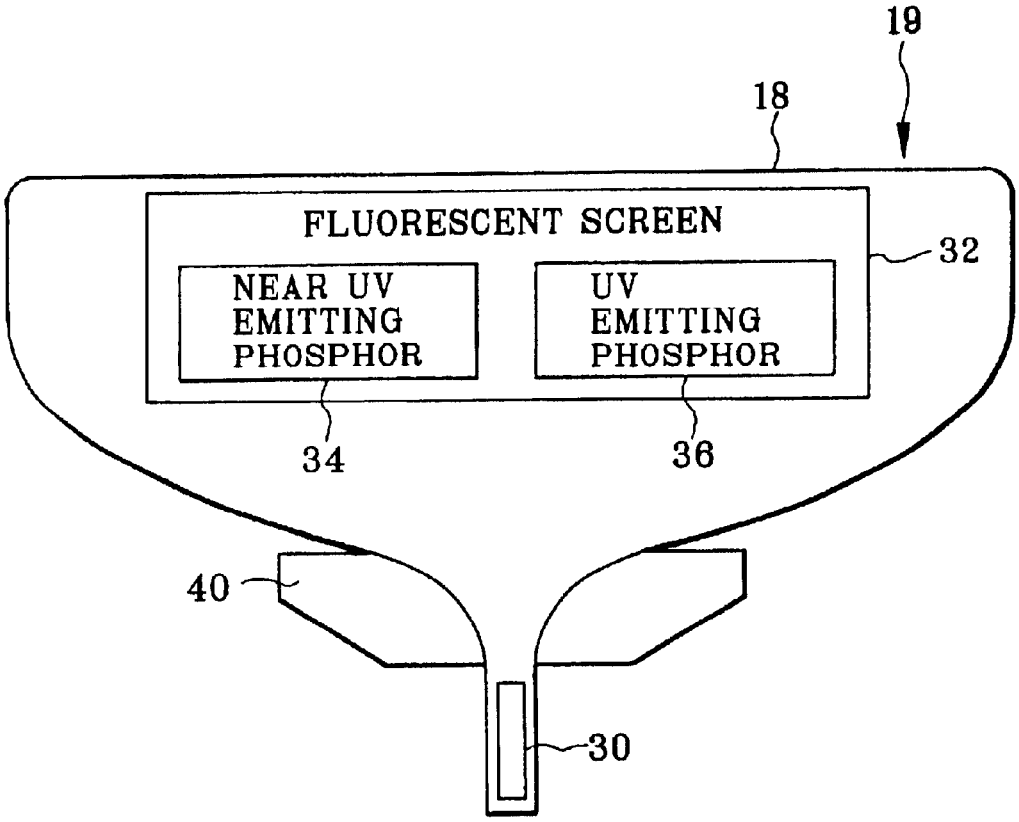
FIG. 1A is an explanatory view in side elevation, illustrating a Braun tube as a photo fixer in the printer.

In FIG. 1A, the Braun tube 19 in the photo fixer 17 of the present invention is illustrated. A fluorescent screen 32 or fluorescent film as a coating is disposed internally from the ray applying surface 18. The fluorescent screen 32 is constituted by near ultraviolet emitting phosphor 34 and ultraviolet emitting phosphor 36. The near ultraviolet emitting phosphor 34 for a medium wavelength emits near ultraviolet rays of a wavelength range of 420–450 nm which is optimized for fixing the yellow coloring layer. The ultraviolet emitting phosphor 36 for a short wavelength emits ultraviolet rays of a wavelength range of 365–390 nm which is optimized for fixing the magenta coloring layer. An electron beam gun 30 as electron radiation source is included in the Braun tube 19, emits an electron beam. An electron deflecting unit 40 deflects the electron beam, and causes it to scan the near ultraviolet emitting phosphor 34 and the ultraviolet emitting phosphor 36 selectively, so that the yellow and magenta coloring layers in the recording material 2 are fixed selectively.

The use of the Braun tube 19 makes it possible to set the recording material 2 at an unchanged distance from the ray applying surface 18 of the photo fixer 17. Thus, an amount of emitted ultraviolet rays can be constant, to regularize a manner of the fixation.

Figure 2:
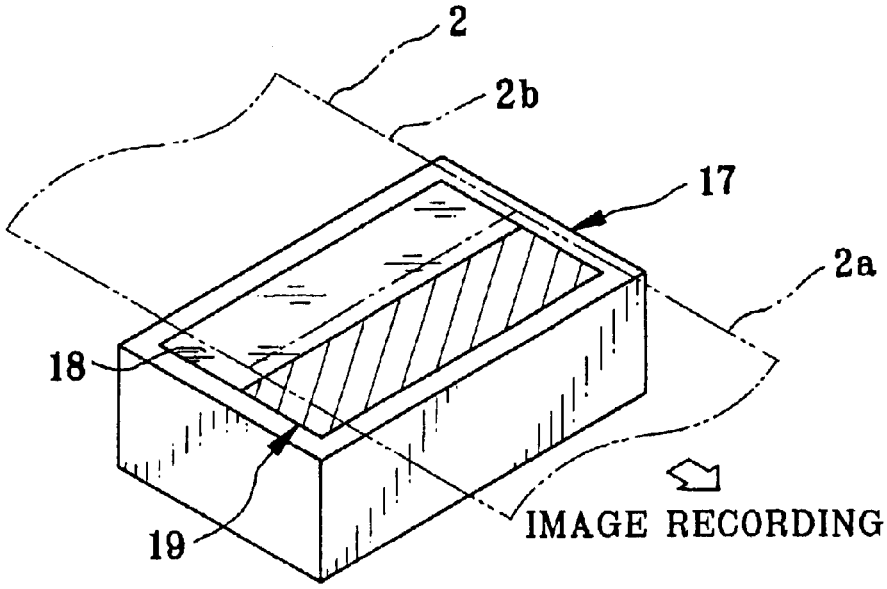
FIG. 2 is a perspective illustrating the photo fixer together with a color thermosensitive recording material.

Also, cells are defined in the ray applying surface 18 of the photo fixer 17. A position of scanning of the electron beam from the electron beam gun 30 is controlled by the electron deflecting unit 40, so that effective cells can be selected among the cells to emit electromagnetic rays in any desired manner. In FIG. 2, a recording area 2*a* is defined in the recording material 2, where a second recording area 2*b* succeeds to the recording area 2*a*. The photo fixer 17 is controlled to change those among the cells to be driven in consideration of a speed of conveying the recording material 2, and thus applies ultraviolet rays to the recording area 2*a* without application to the second recording area 2*b*. Therefore, a radiation source shutter mechanism used in known thermal printers is unnecessary for the purpose of limiting a range of application of the rays. It is possible to install the photo fixer 17 at a smaller distance from the recording material 2. Furthermore, the distance can be zero (0). Namely, the photo fixer 17 can contact the recording material 2 during operation of the fixation. Of course, it is desirable to prevent occurrence of scratches to the recording material 2 in contact with the photo fixer 17.

Figure 3:
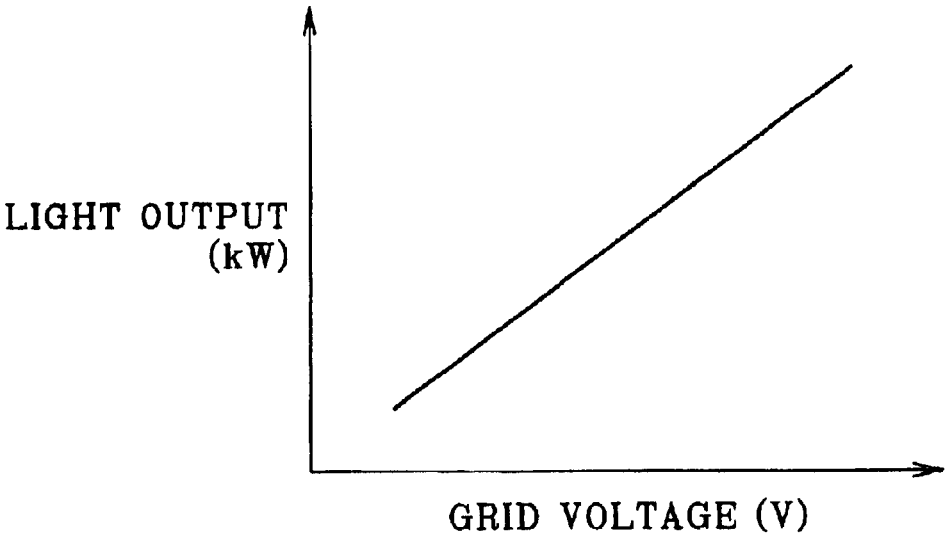
FIG. 3 is a graph illustrating a relationship between the light output amount and the grid voltage of the Braun tube.

A graph in FIG. 3 is referred to now. It is possible in the Braun tube 19 to change a ray emitting amount easily by changing a grid voltage or control voltage. Therefore, the photo fixer 17 is easy to adjust in relation to the ray emitting amount. The quality in producing prints can be higher.

A cutter 21 is disposed in the advancing direction A from the photo fixer 17, and cuts the recording material 2 at a predetermined size of each one print. An exit slot 22 is disposed in the advancing direction A from the cutter 21, and exits prints obtained from the recording material 2 after the printing operation.

The operation of the above construction is described now. When a command signal for starting printing is input as illustrated in FIG. 1 at the thermal printer, the feeder motor (not shown) is driven to start the supply roller 4 to rotate. The supply roller 4 rotating in the counterclockwise direction unwinds and advances the recording material 2 from the recording material roll 3. The recording material 2 from the recording material roll 3 is sent to a position between the capstan roller 8 and the pinch roller 9 in the feeder roller set 7 which is disposed downstream in the advancing direction A.

There is a sensor (not shown), which detects passage of an advancing edge of the recording material 2 at a position between the capstan roller 8 and the pinch roller 9 in the feeder roller set 7. Then the shifter mechanism for the pinch roller 9 with the cam, solenoid or the like discontinues being driven. The pinch roller 9 is caused to shift by the spring, and squeezes the recording material 2 between the same and the capstan roller 8.

The capstan roller 8 in the feeder roller set 7 is rotated in the advancing direction A by the feeder motor, to draw the recording material 2 from the recording material roll 3 forwards. When the recording material 2 is conveyed at an amount equal to a length of one print, then the feeder roller set 7 is stopped in a provisional manner to position the recording material 2.

After the recording material 2 stops being conveyed, the platen roller 13 is shifted down to nip the recording material 2 between the same and the thermal head 12. Then the feeder roller set 7 conveys the recording material 2 in the image recording direction B at a printing speed that is predetermined lower than a first speed for the initial advance. When a beginning edge of the recording area 2*a* of the recording material 2 comes to the heating element array 14, the heating element array 14 in the thermal head 12 is driven according to density data of yellow image, to print the yellow image to the yellow coloring layer. When conveyed in the image recording direction B, the recording material 2 is wound back to the recording material roll 3 by rotation of the supply roller 4.

Upon completing the yellow recording, rotation of the feeder roller set 7 in the image recording direction B is stopped. The platen roller 13 is shifted up to release the recording material 2 from being nipped. The feeder roller set 7 conveys the recording material 2 in the advancing direction A at the feeding speed predetermined for the advance. When the beginning edge of the recording area 2*a* in the recording material 2 comes to a position opposed to an edge of the photo fixer 17 closer to the exit slot 22, the movement of the recording material 2 in the advancing direction A is stopped.

Then the feeder roller set 7 starts again to rotate, to convey the recording material 2 in the image recording direction B. At the same time, the electron beam gun 30 in the photo fixer 17 emits an electron beam, and is caused by the electron deflecting unit 40 to scan only the near ultraviolet emitting phosphor 34 for the yellow fixation. Near ultraviolet rays of a wavelength range of 420–450 nm are applied to the recording material 2 to fix the yellow coloring layer. To prevent the second recording area 2*b* from receiving the near ultraviolet rays, a driven group of cells included in the cells in the photo fixer 17 is changed and enlarged according to conveyance of the recording area 2*a* in the image recording direction B. See FIG. 2. No application of the near ultraviolet rays to the second recording area 2*b* occurs. The second recording area 2*b* can remain unused, and can be free from fixation before image recording.

When the beginning edge of the recording area 2*a* of the recording material 2 comes to the heating element array 14 during the yellow fixation, then the recording material 2 is stopped. The platen roller 13 and the thermal head 12 are caused to squeeze the recording material 2. Then the recording material 2 starts being conveyed in the image recording direction B. The thermal head 12 is driven to record a magenta image to the magenta coloring layer.

Upon completing the magenta recording, rotation of the feeder roller set 7 in the image recording direction B is stopped. The platen roller 13 is shifted up to release the recording material 2 from being nipped. The recording material 2 is conveyed in the advancing direction A. When the beginning edge of the recording area 2*a* in the recording material 2 comes to a position opposed to an edge of the photo fixer 17 closer to the exit slot 22, the movement of the recording material 2 in the advancing direction A is stopped.

The feeder roller set 7 starts again to rotate, to convey the recording material 2 in the image recording direction B. At the same time, the electron beam gun 30 in the photo fixer 17 emits an electron beam, and is caused by the electron deflecting unit 40 to scan only the ultraviolet emitting phosphor 36 for the magenta fixation. Ultraviolet rays of a wavelength range of 365–390 nm are applied to the recording material 2 to fix the magenta coloring layer. To prevent the second recording area 2*b* from receiving the ultraviolet rays, a group of cells included in the cells in the photo fixer 17 is changed according to conveyance of the recording area 2*a* in the image recording direction B.

After the beginning edge of the recording area 2*a* of the recording material 2 comes to the heating element array 14 during the magenta fixation, then the thermal head 12 is driven to record a cyan image to the cyan coloring layer. Upon completion of the cyan recording, the feeder roller set 7 conveys the recording material 2 in the advancing direction A, to move the advancing edge of the recording material 2 to the outside of the exit slot 22. The cutter 21 is driven to cut the recording material 2 to obtain a color print of a sheet shape.

Figure 4:
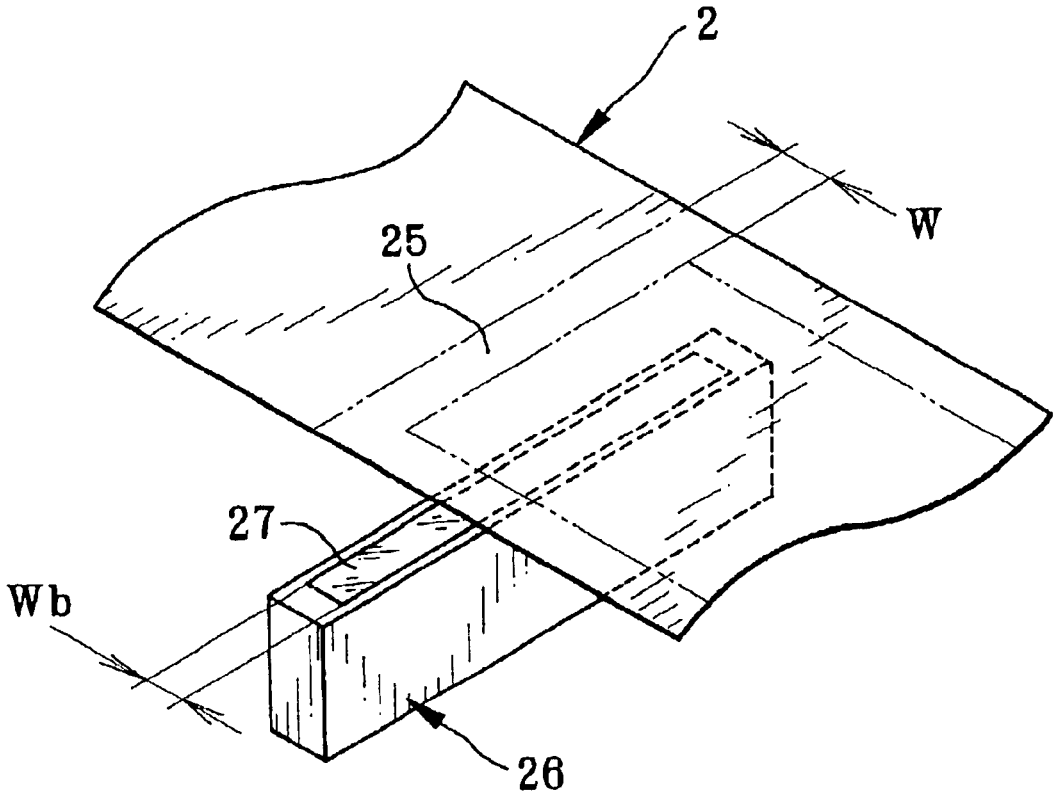
FIG. 4 is a perspective illustrating another preferred photo fixer constituted by a Braun tube in a long shape.

In the above embodiment, the Braun tube 19 has an aspect ratio with a considerable size in the advancing direction A of the recording material 2. Furthermore, another preferred photo fixer 26 may have a Braun tube 27 or CRT as radiation source in a form illustrated in FIG. 4. Let Wb be a size of the Braun tube 27 in the advancing direction A. Let W be a size of a margin area 25 in the advancing direction A of the recording material 2. The Braun tube 27 of the photo fixer 26 used herein satisfies the condition of Wb<W. The use of the Braun tube 27 is effective in simplifying the control of the photo fixer 26, because it is unnecessary to vary a region of driven cells among the cells.

The control of the photo fixer related to a driven region of the cells according to the invention can be used in manners other than the substitute for the shutter mechanism. For example, the driven region of the cells in the photo fixer can be varied in a frame shape, a shape of a certain object or symbol, the like. This is effective in obtaining special effects of image trimming, forming a specifically shaped margin on an edge of the recording material, and the like. If the photo fixer is controlled to set the driven region of the cells in a shape of letters or words, it is possible to record letters or words in a superimposed manner on the original image in the print.

In the above embodiments, the thermal printer is used with the continuous thermosensitive recording material, which is cut after the printing to obtain sheets as color prints. Furthermore, a thermal printer of the invention may be a type for use with a recording sheet in a limited size without a continuous form. In the above embodiments, the platen roller 13 is used. However, a platen drum of a great diameter can be incorporated in a thermal printer of the invention, for the purpose of supporting the recording material during a printing operation.

Furthermore, the photo fixer of the invention may be used in devices other than a color thermal printer. Such devices may include a printer for use with recording paper or material of a photo fixable type, and an exposing device used for manufacturing a semiconductor device or printed circuit board.

Also, electromagnetic rays may be visible light, for example violet light of which a wavelength may be short. Furthermore, a thermal printer of the invention may be monochromatic. In the above embodiments, the fluorescent screen 32 includes the near ultraviolet emitting phosphor 34 and the ultraviolet emitting phosphor 36. However, only one type of electromagnetic ray emitting phosphor may constitute the fluorescent screen 32, to emit rays of one type.

In the above embodiments, the photo fixer 17, 26 is constituted by the Braun tube 19, 27 of a flat type. However, other types of electromagnetic radiation sources may be used as photo fixer, including a plasma display panel (PDP), organic EL (electroluminescent) panel, and the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A photo fixer for fixing an image on recording material by application of electromagnetic rays, comprising:

an electron radiation source for emitting electrons; and a fluorescent screen, excited by said electrons, for generating said electromagnetic rays, wherein said fluorescent screen is flat.

2. A photo fixer as defined in claim 1, wherein:

said electromagnetic rays are near ultraviolet rays or ultraviolet rays; and said recording material is thermosensitive recording material and has photo fixability in response to said near ultraviolet rays or ultraviolet rays.

3. A photo fixer as defined in claim 2, wherein said electron radiation source and said fluorescent screen constitute a Braun tube.

4. A photo fixer as defined in claim 1, wherein:

said recording material comprises a color thermosensitive recording material, comprising first, second and third thermosensitive coloring layers for developing at least three colors, wherein, initially said first coloring layer is colored by thermal recording, then said second coloring layer is colored by thermal recording, said first and second coloring layers having said photo fixability in response to said near ultraviolet rays or ultraviolet rays of respectively first and second wavelength ranges;

said fluorescent screen comprises:

a first area coated with first phosphor material; and a second area coated with second phosphor material, disposed adjacent to said first area, said first and second areas selectively emitting said near ultraviolet rays or ultraviolet rays of said first and second wavelength ranges.

5. A photo fixer according to claim 1, wherein said electron radiation source and said fluorescent screen constitute a Braun tube.

6. A photo fixer according to claim 1, wherein said fluorescent screen is flat on a first surface aligned with the recording material.

7. A photo fixer according to claim 1, wherein said electron radiation source is an electron beam gun.

8. A photo fixer according to claim 1, wherein said fluorescent screen comprises a near UV emitting phosphor and a UV emitting phosphor.

9. A photo fixer according to claim 1, further comprising:

means for controlling impingement of said electrons on the fluorescent screen so that excited areas of the fluorescent screen correspond to areas requiring fixing on said recording material.

10. A thermal printer, comprising a thermal head for recording an image by heating thermosensitive recording material being fed in a first direction, and a photo fixer for fixing said image on aid recording material by application of electromagnetic rays, said photo fixer comprising:

an electron radiation source for emitting electrons; and a fluorescent screen, excited by said electrons, for generating said electromagnetic rays, wherein said fluorescent screen is flat.

11. A thermal printer as defined in claim 10, wherein:

said electromagnetic rays are near ultraviolet rays or ultraviolet rays;

said recording material comprises a color thermosensitive recording material, comprising first, second and third thermosensitive coloring layers for developing at least three colors, wherein, initially said first coloring layer is colored by thermal recording, then said second coloring layer is colored by thermal recording, said first and second coloring layers having photo fixability in response to said near ultraviolet rays or ultraviolet rays of respectively first and second wavelength ranges.

12. A thermal printer as defined in claim 11, wherein said electron radiation source and said fluorescent screen constitute a Braun tube.

13. A thermal printer as defined in claim 12, wherein:

said fluorescent screen is constituted by first and second areas, excited selectively by said electron, disposed in said first direction;

said first area is coated with first phosphor material, for emitting near ultraviolet rays;

and said second area is coated with second phosphor material, for emitting ultraviolet rays.

14. A thermal printer as defined in claim 10, further comprising:

a feeder for feeding said recording material in a feeding direction; wherein:

said thermal head records said image into a recording area of said recording material, which is separated from a second recording area by a margin area;

said photo fixer has a first size in said feeding direction;

said first size being smaller than a second size of said margin area in said feeding direction; and said photo fixer turning off when opposed to said margin area.

15. A thermal printer according to claim 10, wherein said electron radiation source and said fluorescent screen constitute a Braun tube.

16. A thermal printer according to claim 10, wherein said fluorescent screen is flat on a first surface aligned with the recording material.

17. A thermal printer according to claim, 10 wherein said electron radiation source is an electron beam gun.

18. A thermal printer according to claim 10, wherein said fluorescent screen comprises a near UV emitting phosphor and a UV emitting phosphor.

19. A thermal printer according to claim 10, further comprising:

means for controlling impingement of said electrons on the fluorescent screen so that excited areas of the fluorescent screen correspond to areas requiring fixing on said recording material.

20. A thermal printer according to claim 10, wherein said fluorescent screen of said photo fixer is shaped so that an area thereof maintains a consistent gap to an area of said recording material.

21. A thermal printer according to claim 10, wherein the distance between said photo fixer and said recording material is 0.

22. A photo fixer for fixing an image on recording material by application of electromagnetic rays, comprising a Braun tube for generating said electromagnetic rays.

23. A thermal printer comprising:

a thermal head for recording an image heating thermosensitive recording material being fed in a first direction; and a Braun tube for fixing said image on said recording material by application of electromagnetic rays.

* * * * *